US010865793B2

(12) United States Patent
Shaffer et al.

(10) Patent No.: US 10,865,793 B2
(45) Date of Patent: Dec. 15, 2020

(54) SCROLL TYPE DEVICE HAVING LIQUID COOLING THROUGH IDLER SHAFTS

(71) Applicant: Air Squared, Inc., Broomfield, CO (US)

(72) Inventors: Bryce R Shaffer, Broomfield, CO (US); Justin Mattice, Broomfield, CO (US); John Wilson, Broomfield, CO (US)

(73) Assignee: Air Squared, Inc., Broomfield, CO (US)

( * ) Notice: Subject to any disclaimer, the term of this patent is extended or adjusted under 35 U.S.C. 154(b) by 211 days.

(21) Appl. No.: 15/732,593

(22) Filed: Nov. 30, 2017

(65) Prior Publication Data

US 2018/0163726 A1 Jun. 14, 2018

Related U.S. Application Data

(60) Provisional application No. 62/497,869, filed on Dec. 6, 2016.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 29/04*** | (2006.01) |
| ***F04C 27/00*** | (2006.01) |

(Continued)

(52) U.S. Cl.

CPC ..... *F04C 29/04* (2013.01); *F01C 17/063* (2013.01); *F04C 18/0215* (2013.01); *F04C 27/00* (2013.01); *F04C 27/009* (2013.01); *F04C 2240/30* (2013.01); *F04C 2240/40* (2013.01); *F04C 2240/60* (2013.01)

(58) Field of Classification Search

CPC .. F04C 18/0215; F04C 18/0253; F04C 27/00; F04C 27/009; F04C 29/04; F04C 2240/30; F04C 2240/40; F04C 2240/60; F01C 17/063

USPC ..... 418/55.1–55.6, 57, 60, 94

See application file for complete search history.

(56) References Cited

U.S. PATENT DOCUMENTS

| | | | |
|---|---|---|---|
| 801,182 | A | 10/1905 | Creux |
| 2,079,118 | A | 5/1937 | Hingst |
| 2,330,121 | A | 9/1943 | Heintz |

(Continued)

FOREIGN PATENT DOCUMENTS

| | | |
|---|---|---|
| CN | 104235018 | 12/2014 |
| CN | 104632636 | 5/2015 |

(Continued)

OTHER PUBLICATIONS

"Digital Scroll Compressor Technology," Wikipedia, 2010, 3 pages [retrieved online from: en.wikipedia.org/wiki/Digital_Scroll_Compressor_Technology].

(Continued)

*Primary Examiner* — Theresa Trieu

(74) *Attorney, Agent, or Firm* — Sheridan Ross P.C.

(57) ABSTRACT

A scroll device is disclosed having a housing, a motor having a shaft, an orbiting scroll connected to the shaft for moving the orbiting scroll, a fixed scroll mated to the orbiting scroll, an idler shaft for aligning the orbiting scroll and the fixed scroll, an inlet formed in the housing and/or the fixed scroll for receiving a cooling liquid, and a channel formed in the idler shaft for receiving the cooling liquid.

20 Claims, 9 Drawing Sheets

(51) Int. Cl.
*F04C 18/02* (2006.01)
*F01C 17/06* (2006.01)

(56) References Cited

U.S. PATENT DOCUMENTS 2,968,157 A 1/1961 Cronan
3,011,694 A 12/1961 Mulhouse et al.
3,470,704 A 10/1969 Kantor
3,613,368 A 10/1971 Doerner
3,802,809 A 4/1974 Vulliez
3,842,596 A 10/1974 Gray
3,986,799 A 10/1976 McCullough
3,986,852 A 10/1976 Doerner et al.
3,994,635 A 11/1976 McCullough
3,994,636 A 11/1976 McCullough et al.
3,999,400 A 12/1976 Gray
4,065,279 A 12/1977 McCullough
4,069,673 A 1/1978 Lapeyre
4,082,484 A 4/1978 McCullough
4,157,234 A 6/1979 Weaver et al.
4,192,152 A 3/1980 Armstrong et al.
4,216,661 A 8/1980 Tojo et al.
4,300,875 A 11/1981 Fischer et al.
4,340,339 A 7/1982 Hiraga et al.
4,382,754 A 5/1983 Shaffer et al.
4,395,885 A 8/1983 Cozby
4,411,605 A 10/1983 Sauls
4,415,317 A 11/1983 Buttersworth
4,416,597 A 11/1983 Eber et al.
4,436,495 A 3/1984 McCullough
4,457,674 A 7/1984 Kawano et al.
4,462,771 A 7/1984 Teegarden
4,472,120 A 9/1984 McCullough
4,477,238 A 10/1984 Terauchi
4,511,091 A 4/1985 Vasco
4,673,339 A 6/1987 Hayano et al.
4,718,836 A 1/1988 Pottier et al.
4,722,676 A 2/1988 Sugimoto
4,726,100 A 2/1988 Etemad et al.
4,730,375 A 3/1988 Nakamura et al.
4,732,550 A 3/1988 Suzuki et al.
4,802,831 A 2/1989 Suefuji et al.
4,867,657 A 9/1989 Kotlarek et al.
4,875,839 A 10/1989 Sakata et al.
4,892,469 A 1/1990 McCullough et al.
5,013,226 A 5/1991 Nishida
5,037,280 A 8/1991 Nishida et al.
5,040,956 A 8/1991 Barito et al.
5,044,904 A 9/1991 Richardson, Jr.
5,051,079 A 9/1991 Richardson, Jr.
5,082,430 A 1/1992 Guttinger
5,099,658 A 3/1992 Utter et al.
5,108,274 A 4/1992 Kakuda et al.
5,127,809 A 7/1992 Amata et al.
5,142,885 A 9/1992 Utter et al.
5,160,253 A 11/1992 Okada et al.
5,214,932 A 6/1993 Abdelmalek
5,222,882 A 6/1993 McCullough
5,228,309 A 7/1993 McCullough
5,232,355 A 8/1993 Fujii et al.
5,242,284 A 9/1993 Mitsunaga et al.
5,258,046 A 11/1993 Haga et al.
5,338,159 A 8/1994 Riffe et al.
5,417,554 A 5/1995 Kietzman et al.
5,449,279 A 9/1995 Hill et al.
5,466,134 A 11/1995 Shaffer et al.
5,496,161 A 3/1996 Machida et al.
5,609,478 A 3/1997 Utter et al.
5,616,015 A 4/1997 Liepert
5,632,612 A 5/1997 Shaffer
5,632,613 A 5/1997 Shin et al.
5,752,816 A 5/1998 Shaffer
5,759,020 A 6/1998 Shaffer
5,803,723 A 9/1998 Suefuji et al.
5,836,752 A 11/1998 Calhoun et al.
5,842,843 A 12/1998 Haga
5,855,473 A 1/1999 Liepert
5,857,844 A 1/1999 Lifson et al.
5,873,711 A 2/1999 Lifson
5,938,419 A 8/1999 Honma et al.
5,951,268 A 9/1999 Pottier et al.
5,961,297 A 10/1999 Haga et al.
5,987,894 A 11/1999 Claudet
6,008,557 A 12/1999 Dornhoefer et al.
6,050,792 A 4/2000 Shaffer
6,068,459 A 5/2000 Clarke et al.
6,074,185 A 6/2000 Protos
6,129,530 A 10/2000 Shaffer
6,179,590 B1 1/2001 Honma et al.
6,186,755 B1 2/2001 Haga
6,190,145 B1 2/2001 Fujioka et al.
6,193,487 B1 2/2001 Ni
6,283,737 B1 9/2001 Kazikis et al.
6,379,134 B2 4/2002 Iizuka
6,434,943 B1 8/2002 Garris
6,439,864 B1 8/2002 Shaffer
6,464,467 B2 10/2002 Sullivan et al.
6,511,308 B2 1/2003 Shaffer
6,644,946 B2 11/2003 Nakane et al.
6,663,364 B2 12/2003 Okada et al.
6,712,589 B2 3/2004 Mod et al.
6,736,622 B1 5/2004 Bush et al.
6,905,320 B2 6/2005 Satoh et al.
6,922,999 B2 8/2005 Kimura et al.
7,124,585 B2 10/2006 Kim et al.
7,181,928 B2 2/2007 de Larminat
7,249,459 B2 7/2007 Hisanaga et al.
7,306,439 B2 12/2007 Unami et al.
7,314,358 B2 1/2008 Tsuchiya
7,439,702 B2 10/2008 Smith et al.
7,458,152 B2 12/2008 Sato
7,458,414 B2 12/2008 Simon
7,836,696 B2 11/2010 Uno et al.
7,942,655 B2 5/2011 Shaffer
7,980,078 B2 7/2011 McCutchen et al.
8,007,260 B2 8/2011 Yanagisawa
8,087,260 B2 1/2012 Ogata et al.
8,186,980 B2 5/2012 Komai et al.
8,328,544 B2 12/2012 Iwano et al.
8,484,974 B1 7/2013 Monson et al.
8,523,544 B2 9/2013 Shaffer
8,668,479 B2 3/2014 Shaffer
8,674,525 B2 3/2014 Van Den Bossche et al.
8,858,203 B2 10/2014 Kanizumi et al.
9,022,758 B2 5/2015 Roof et al.
9,028,230 B2 5/2015 Shaffer
9,074,598 B2 7/2015 Shaffer et al.
9,657,733 B2 5/2017 Chadwick et al.
9,784,139 B2 10/2017 Shaffer et al.
9,885,358 B2 2/2018 Shaffer
1,022,185 A1 3/2019 Shaffer et al.
2001/0038800 A1 11/2001 Kumura et al.
2001/0043878 A1 11/2001 Sullivan et al.
2002/0011332 A1 1/2002 Oh et al.
2002/0039534 A1 4/2002 Moroi et al.
2002/0071779 A1 6/2002 Moroi et al.
2003/0017070 A1 1/2003 Moroi et al.
2003/0138339 A1 7/2003 Scancarello
2003/0223898 A1 12/2003 Fujioka et al.
2004/0020206 A1 2/2004 Sullivan et al.
2004/0184940 A1 9/2004 Nakane et al.
2004/0255591 A1 12/2004 Hisanga et al.
2005/0025651 A1 2/2005 Sowa et al.
2005/0031469 A1 2/2005 Yanagisawa et al.
2005/0220649 A1* 10/2005 Sato ..... F04C 18/0215 418/55.3
2006/0016184 A1 1/2006 Simon
2006/0045783 A1 3/2006 Yanagisawa et al.
2006/0130495 A1 6/2006 Dieckmann et al.
2007/0071626 A1 3/2007 Tsuchiya et al.
2007/0104602 A1* 5/2007 Ishikawa ..... F04C 18/0215 418/55.3
2007/0108934 A1 5/2007 Smith et al.
2007/0172373 A1 7/2007 Ni

(56) References Cited

U.S. PATENT DOCUMENTS

| | | | |
|---|---|---|---|
| 2007/0231174 | A1 | 10/2007 | Ishizuki |
| 2008/0159888 | A1 | 7/2008 | Nakayama et al. |
| 2008/0193311 | A1 | 8/2008 | Helies |
| 2008/0206083 | A1 | 8/2008 | Suefuji et al. |
| 2009/0148327 | A1 | 6/2009 | Carter et al. |
| 2009/0246055 | A1 | 10/2009 | Stehouwer et al. |
| 2010/0111740 | A1 | 5/2010 | Ni |
| 2010/0254835 | A1 | 10/2010 | Kane et al. |
| 2010/0287954 | A1 | 11/2010 | Harman et al. |
| 2011/0129362 | A1 | 6/2011 | Kameya et al. |
| 2012/0134862 | A1 | 5/2012 | Hockliffe et al. |
| 2013/0149179 | A1 | 6/2013 | Sato et al. |
| 2013/0207396 | A1 | 8/2013 | Tsuboi |
| 2013/0232975 | A1 | 9/2013 | Shaffer et al. |
| 2014/0023540 | A1 | 1/2014 | Heidecker et al. |
| 2014/0260364 | A1 | 9/2014 | Litch |
| 2017/0045046 | A1 | 2/2017 | Afshari |
| 2017/0051741 | A1 | 2/2017 | Shaffer et al. |
| 2017/0074265 | A1 | 3/2017 | Asami et al. |
| 2017/0268514 | A1 | 9/2017 | Shaffer |
| 2017/0284284 | A1 | 10/2017 | Takamiya |
| 2017/0306956 | A1 | 10/2017 | Monet |
| 2017/0321699 | A1 | 11/2017 | Kawano et al. |
| 2017/0362962 | A1 | 12/2017 | Shaffer et al. |
| 2018/0163725 | A1 | 6/2018 | Valdez et al. |
| 2018/0216498 | A1 | 8/2018 | Shaffer et al. |
| 2019/0211824 | A1 | 7/2019 | Shaffer et al. |

FOREIGN PATENT DOCUMENTS

| | | |
|---|---|---|
| CN | 105402134 | 3/2016 |
| DE | 460936 | 6/1928 |
| DE | 19957425 | 8/2000 |
| EP | 0513824 | 11/1992 |
| EP | 0780576 | 6/1997 |
| EP | 1464838 | 10/2004 |
| EP | 3239526 | 11/2017 |
| GB | 0513827 | 10/1939 |
| GB | 2002455 | 2/1979 |
| GB | 1575684 | 9/1980 |
| JP | S56-019369 | 2/1981 |
| JP | S57-171002 | 10/1982 |
| JP | H05-157076 | 6/1993 |
| JP | H07-109981 | 4/1995 |
| JP | H07-324688 | 12/1995 |
| JP | H08-261182 | 10/1996 |
| JP | 2011-012629 | 1/2011 |
| WO | WO 2004/008829 | 1/2004 |
| WO | WO 2009/050126 | 4/2009 |
| WO | WO 2015/164453 | 10/2015 |
| WO | WO 2017/089745 | 6/2017 |

OTHER PUBLICATIONS

Official Action for U.S. Appl. No. 15/731,929, dated Jun. 4, 2019 10 pages.
Notice of Allowance for U.S. Appl. No. 15/731,929, dated Aug. 14, 2019 9 pages.
Notice of Allowance for U.S. Appl. No. 15/731,324, dated Aug. 2, 2019 11 pages.
Notice of Allowance for U.S. Appl. No. 15/373,979, dated Apr. 26, 2019 9 pages.
"Heat Pump and Refrigeration Cycle," Wikipedia, last updated May 10, 2013, 4 pages [retrieved online from: en.wikipedia.org/wiki/Heat_pump_and_refrigeration_cycle].
"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Organic Rankine Cycle," Wikipedia, last modified May 19, 2013, 4 pages [retrieved online from: en.wikipedia.org/wiki/Organic_Rankine_Cycle].
"Rankine Cycle," Wikipedia, last modified Apr. 29, 2013, 4 pages [retrieved online from: en.wikipedia.org/wiki/Rankine_cycle].
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for Interiantional (PCT) Patent Application No. PCT/US2018/064427, dated Feb. 5, 2019 14 pages.
International Search Report for International (PCT) Patent Application No. PCT/US01/43523, dated Jun. 5, 2002 1 page.
International Search Report for International (PCT) Patent Application No. PCT/US01/50377, dated May 13, 2002 1 page.
Partial Search Report for European Patent Application No. 13003663.5, dated May 28, 2014 5 pages.
Extended Search Report for European Patent Application No. 13003663.5, dated Sep. 3, 2014 11 pages.
International Search Report and Written Opinion for International (PCT) Patent Application No. PCT/US14/00076, dated Dec. 17, 2014 6 pages.
International Search Report and Written Opinion for International (PCT) Patent Application No. PCT/US18/00118, dated Sep. 24, 2018 19 pages.
Official Action for U.S. Appl. No. 11/703,585, dated Dec. 18, 2009 7 pages.
Official Action for U.S. Appl. No. 11/703,585, dated Jul. 20, 2010 7 pages.
Notice of Allowance for U.S. Appl. No. 11/703,585, dated Feb. 4, 2011 4 pages.
Official Action for U.S. Appl. No. 12/930,140, dated Jan. 14, 2013 22 pages.
Official Action for U.S. Appl. No. 12/930,140, dated Jun. 13, 2013 21 pages.
Notice of Allowance for U.S. Appl. No. 12/930,140, dated Oct. 24, 2013 12 pages.
Official Action for U.S. Appl. No. 13/066,261, dated Feb. 11, 2013 5 pages Restriction Requirement.
Notice of Allowance for U.S. Appl. No. 13/066,261, dated Apr. 4, 2013 13 pages.
Official Action for U.S. Appl. No. 13/987,486, dated Dec. 16, 2013 5 pages Restriction Requirement.
Official Action for U.S. Appl. No. 13/987,486, dated Apr. 23, 2014 13 pages.
Official Action for U.S. Appl. No. 13/987,486, dated Oct. 20, 2014 11 pages.
Notice of Allowance for U.S. Appl. No. 13/987,486, dated Jan. 5, 2015 5 pages.
Corrected Notice of Allowance for U.S. Appl. No. 13/987,486, dated Feb. 20, 2015 8 pages.
Official Action for U.S. Appl. No. 14/544,874, dated Dec. 23, 2016 5 pages Restriction Requirement.
Official Action for U.S. Appl. No. 14/544,874, dated Jan. 26, 2017 9 pages.
Official Action for U.S. Appl. No. 14/544,874, dated Jul. 21, 2017 6 pages.
Notice of Allowance for U.S. Appl. No. 14/544,874, dated Sep. 28, 2017 5 pages.
Official Action for U.S. Appl. No. 15/330,223, dated Nov. 15, 2017 6 pages Restriction Requirement.
Official Action for U.S. Appl. No. 15/330,223, dated Feb. 7, 2018 10 pages.
Official Action for U.S. Appl. No. 15/330,223, dated Aug. 7, 2018 10 pages.
Official Action for U.S. Appl. No. 15/330,223, dated Jan. 11, 2019 14 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.

(56) References Cited

OTHER PUBLICATIONS

Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/756,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 15/731,324, dated Feb. 7, 2019 15 pages.
Official Action for U.S. Appl. No. 15/373,979, dated Jan. 29, 2019 12 pages.
"Operating Manual: OM WGZC-2 Water-Cooled Scroll Compressor Chillers," McQuay International, 2010, 102 pages.
"R410A // Hermetic Scroll Compressors," Bitzer, 2016, 12 pages.
"Refrigeration Technologies: scroll-compressor chillers," Misto, last modified Jan. 2013, 7 pages.
Notice of Allowance for U.S. Appl. No. 15/330,223, dated Jan. 23, 2020 10 pages.
Official Action for U.S. Appl. No. 15/932,150, dated Nov. 25, 2019 26 pages.
Official Action for U.S. Appl. No. 15/932,150, dated Mar. 5, 2020 19 pages.
International Preliminary Report on Patentability for International (PCT) Patent Application No. PCT/US18/00118, dated Jun. 11, 2020 13 pages.
Notice of Allowance for U.S. Appl. No. 15/932,150, dated May 14, 2020 9 pages.
Official Action for U.S. Appl. No. 16/275,943, dated Oct. 9, 2020 15 pages.
Official Action for U.S. Appl. No. 16/213,111, dated Sep. 30, 2020 22 pages.

* cited by examiner

SCROLL TYPE DEVICE HAVING LIQUID COOLING THROUGH IDLER SHAFTS

CROSS REFERENCE TO RELATED APPLICATION

This non provisional patent application claims priority to the provisional patent application having Ser. No. 62/497,869, filed Dec. 6, 2016.

BACKGROUND OF THE DISCLOSURE

This disclosure relates to a scroll type device and more particularly to a scroll type device, such as a compressor, expander, or a vacuum pump, having liquid cooling though idler shafts.

Scroll devices have been used as compressors, expanders, pumps, and vacuum pumps for many years. In general, they have been limited to a single stage of compression due to the complexity of two or more stages. In a single stage, a spiral involute or scroll upon a rotating plate orbits within a fixed spiral or scroll upon a stationery plate. A motor shaft turns a shaft that orbits a scroll eccentrically within a fixed scroll. The eccentric orbit forces a gas through and out of the fixed scroll thus creating a vacuum in a container in communication with the fixed scroll. An expander operates with the same principle only turning the scrolls in reverse. When referring to compressors, it is understood that a vacuum pump can be substituted for compressor and that an expander can be an alternate usage when the scrolls operate in reverse from an expanding gas.

Scroll type compressors, expanders, and vacuum pumps generate heat as part of the compression, expansion, or pumping process. The higher the pressure ratio the higher the temperature of the compressed fluid. In order to keep the compressor hardware to a reasonable temperature, the compressor must be cooled or damage may occur to the hardware. In some cases, cooling is accomplished by blowing cool ambient air over the compressor components. However, in some cases, such as space limitations or that there is too much heat to be dissipated, air cooling may not be effective. The use of a liquid to cool a compressor may be beneficial because liquid has a much higher heat transfer coefficient than air. One attempt to liquid cool a compressor involves the use of a flexible bellows type device to transfer heat from the compressor to the liquid. Although bellows are useful, bellows are also expensive and have limited life. If the bellows fails then the compressor may be damaged.

The present disclosure overcomes the limitations of the prior art where a need exists for liquid cooling of a scroll type device. The present disclosure provides a scroll type device that incorporates liquid cooling through the use of the idler shafts.

SUMMARY OF THE DISCLOSURE

Accordingly, the present disclosure is a scroll device that comprises a housing, a motor having a shaft, an orbiting scroll connected to the shaft for moving the orbiting scroll, a fixed scroll mated to the orbiting scroll, an idler shaft for aligning the orbiting scroll and the fixed scroll, an inlet formed in the housing for receiving a cooling liquid, and a channel formed in the idler shaft for receiving the cooling liquid.

In another embodiment of a scroll device of the present disclosure, a scroll device comprises a housing, a motor having a shaft, an orbiting scroll connected to the shaft for moving the orbiting scroll, a fixed scroll mated to the orbiting scroll, an idler shaft for aligning the orbiting scroll and the fixed scroll, a bearing for supporting the idler shaft, an inlet formed in the housing and/or the fixed scroll for receiving a cooling liquid, a channel formed in the idler shaft for receiving the cooling liquid, and a radial shaft seal for preventing any cooling liquid to leak into the bearing.

In still another embodiment of a scroll device constructed according to the present disclosure, a scroll device comprises a housing, a motor having a shaft, an orbiting scroll connected to the shaft for moving the orbiting scroll, a fixed scroll mated to the orbiting scroll, an idler shaft for aligning the orbiting scroll and the fixed scroll, a bearing for supporting the idler shaft, an inlet formed in the housing for receiving a cooling liquid, a channel formed in the idler shaft for receiving the cooling liquid, and an access cross hole for a sealing check.

Another embodiment of a scroll device comprises a housing, a motor having a shaft, an orbiting scroll connected to the shaft for moving the orbiting scroll, a fixed scroll mated to the orbiting scroll, an idler shaft for aligning the orbiting scroll and the fixed scroll, a bearing for supporting the idler shaft, an inlet formed in the housing for receiving a cooling liquid, a channel formed in the idler shaft for receiving the cooling liquid, and a radial shaft seal for preventing any cooling liquid to leak into the bearing, a seal retainer plate, and a cover.

In yet another embodiment of a scroll device, the scroll device comprises a housing, a motor having a shaft, an orbiting scroll connected to the shaft for moving the orbiting scroll, a fixed scroll mated to the orbiting scroll, an idler shaft for aligning the orbiting scroll and the fixed scroll, a bearing for supporting the idler shaft, an inlet formed in the housing for receiving a cooling liquid, a channel formed in the idler shaft for receiving the cooling liquid, and a plate having a fin for directing flow of the cooling liquid to reduce any stagnated flow of the cooling liquid.

In another embodiment of a scroll device constructed according to the present disclosure, a scroll device comprises a housing, a motor having a shaft, an orbiting scroll connected to the shaft for moving the orbiting scroll, a fixed scroll mated to the orbiting scroll, a first idler shaft, a second idler shaft and a third idler shaft, an inlet formed in the housing for receiving a cooling liquid, and a channel formed in each of the idler shafts for receiving the cooling liquid with the first idler shaft for receiving the cooling liquid to flow in a first direction and the second idler shaft and the third idler shaft for receiving the cooling liquid to flow in a second direction with the first direction being opposite to the second direction.

Also, a scroll device comprises a housing, a motor having a shaft, an orbiting scroll connected to the shaft for moving the orbiting scroll, a fixed scroll mated to the orbiting scroll, a first idler shaft, a second idler shaft and a third idler shaft, a pair of bearings for supporting the idler shafts, an inlet formed in the housing for receiving a cooling liquid, and a channel formed in each of the idler shafts for receiving the cooling liquid.

Various other embodiments of a scroll device are disclosed herein.

Therefore, the present disclosure provides a new and improved scroll device from the machine class of compressors, vacuum pumps, and expanders for gases that incorporates liquid cooling through the use of idler shafts.

The present disclosure provides a scroll type device that is capable of operating at lower temperatures.

The present disclosure also provides a scroll device that is capable of longer life as compared to other scroll type devices.

The present disclosure provides a scroll device that is capable of reducing heat generated by the scroll device through the use of a cooling fluid or liquid that may flow through one or more idler shafts associated with the scroll device.

The present disclosure relates to a scroll device that uses liquid cooling to cool any bearings associated with idler shafts incorporated into the scroll device.

The present disclosure further provides a scroll device that has idler shafts that have channels for a cooling fluid or liquid to flow therein to reduce the temperature of bearings contained within the scroll device so that the useful life of the bearings is increased.

The present disclosure also provides a scroll device that employs a fin design to force the flow any cooling fluid or liquid within the scroll device to reduce an stagnated flow of the cooling fluid or liquid.

Also, the present disclosure provides a scroll device that employees dynamic shaft seals and a bearing slinger cover to prevent the escape of any cooling fluid or liquid from within the scroll device.

The present scroll device has mechanical shaft seals to prevent the escape of any cooling fluid or liquid from within the scroll device that may contact any bearings in the scroll device.

The present disclosure is further directed to a scroll device that uses drains to drain any cooling fluid or liquid away from any bearings in the scroll device.

The present disclosure is directed to a scroll device that uses slingers and drains to drain any cooling fluid or liquid away from any bearings in the scroll device.

The present disclosure is also directed to a scroll device that employees idler shafts that have channels formed therein to allow a cooling fluid or liquid to flow therein with one of the idler shafts being used as an inlet for the cooling fluid or liquid and another idler shaft being used as an exit for the cooling fluid or liquid allowing the cooling fluid to enter and exit and cool the orbiting scroll.

These and other advantages may become more apparent to those skilled in the art upon review of the disclosure as described herein, and upon undertaking a study of the description of its preferred embodiment, when viewed in conjunction with the drawings.

DESCRIPTION OF THE PREFERRED EMBODIMENT

Figure 1:
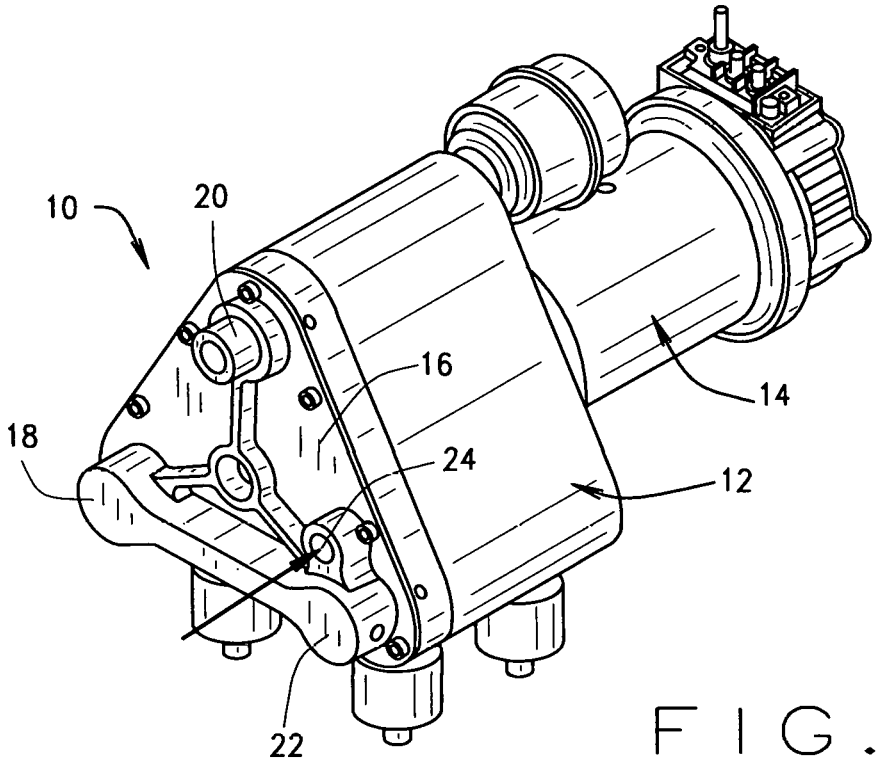
FIG. 1 is a perspective view of a scroll device having liquid cooling through use of idler shafts constructed according to the present disclosure having an inlet for liquid.
Figure 2:
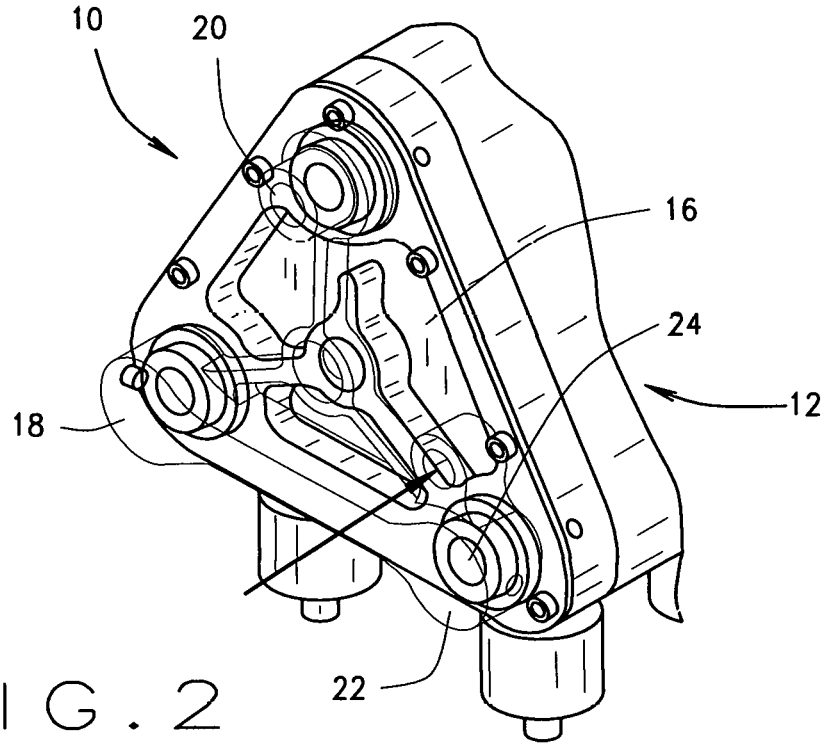
FIG. 2 is a perspective view of a scroll device having liquid cooling through use of idler shafts constructed according to the present disclosure having an inlet for liquid.

Referring now to the drawings, wherein like numbers refer to like items, number 10 identifies a preferred embodiment of a scroll device having liquid cooling though use of idler shafts constructed according to the present disclosure. In FIGS. 1 and 2, the scroll device 10 is shown to comprise a housing 12 that is connected to a motor 14. A fixed scroll 16 has three idler shafts 18, 20, and 22 being spaced approximately 120° apart. The fixed scroll 16 also has an inlet 24. The inlet 24 allows a cooling fluid or liquid (not shown) to be inserted therein. Although not shown in detail in this particular view, it is known that the scroll device 10 has incorporated within the housing 12 components such as an orbiting scroll which is driven by a center shaft connected to the motor 14. The center shaft is supported by a front bearing or a pair of front bearings and a rear bearing or a pair of rear bearings. The motor 14, which may be an electric motor, is used to drive the center shaft. The bearings and the motor 14 are mounted in the housing 12. The fixed scroll 16 is mated to the orbiting scroll. The orbiting scroll has a first involute and the fixed scroll 16 has a second involute. In order to balance the rotary motion of the orbiting scroll, a pair of balance weights may be positioned co-axially with the first involute to dynamically balance the orbiting scroll. Also, a pair of counterweights may be positioned on the center shaft to dynamically balance the orbiting scroll. The orbiting scroll is coupled to the center shaft that moves or orbits the orbiting scroll eccentrically, following a fixed path with respect to the fixed scroll 16, creating a series of crescent-shaped pockets between the two scrolls. In the case of a scroll compressor, the working fluid moves from the periphery (inlet) towards the center (discharge) through increasingly smaller pockets, generating compression. Similar principles apply for a scroll vacuum pump and a scroll expander. The idler shafts 18, 20, and 22 are supported by the front bearings in the orbiting scroll and the rear bearings in the fixed scroll 16. A center line of the idler shaft is offset from a center line of the center shaft. To seal any working fluid within the center shaft a labyrinth seal may be used. The labyrinth seal may be positioned between the bearings or after the rear bearing.

Figure 3:
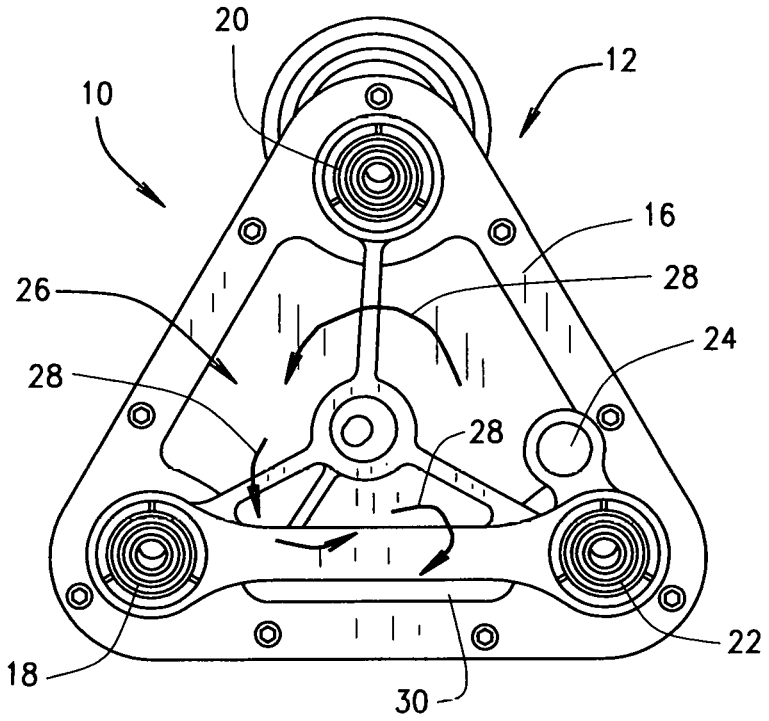
FIG. 3 is a front view of a front face of the scroll device constructed according to the present disclosure.

With reference now to FIG. 3, a front view of the fixed scroll 16 of the scroll device 10 is shown with some of the components within the housing 12 shown in phantom. In this particular view, the scroll device 10 has a fixed scroll passage way 26 formed within the housing 12. Any fluid or liquid 28, shown by arrows, that has entered through the inlet 24, may flow around the passage way 26. Heat generated by the scroll device 10 may be transferred to the liquid 28. A channel 30 is also provided to allow an exit or outlet for the liquid 28. The idler shafts 18, 20, and 222 are also shown.

Figure 4:
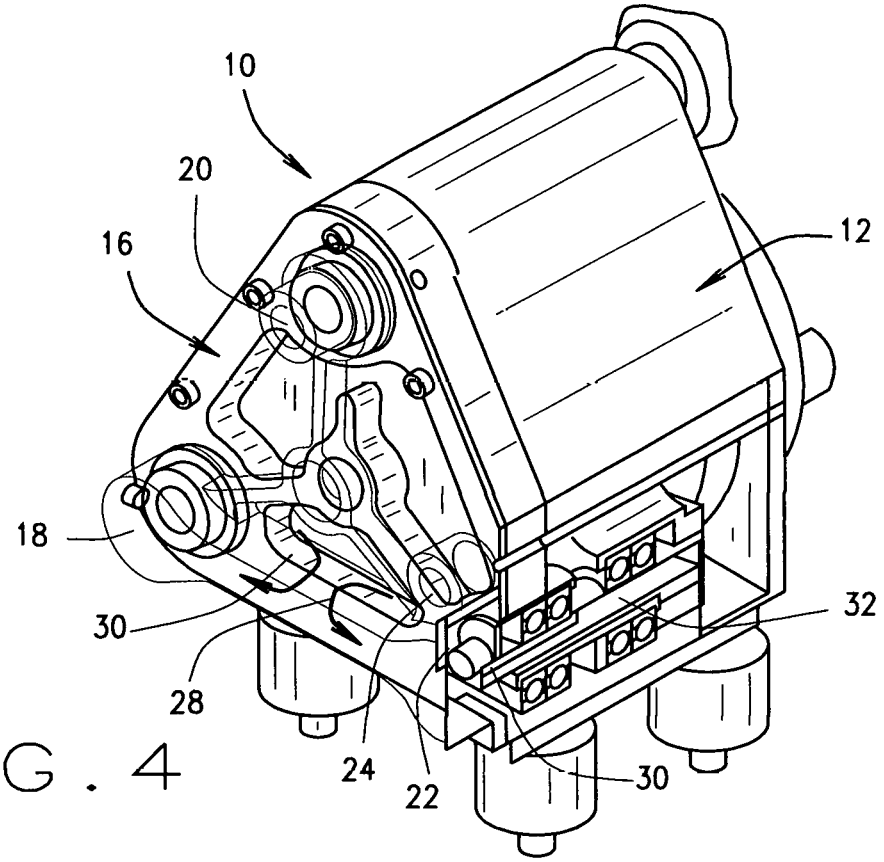
FIG. 4 is a perspective view of the scroll device shown partially in phantom.

FIG. 4 depicts a perspective view of the scroll device 10 shown partially in phantom. The scroll device 10 has the housing 12 and the fixed scroll 16 having the passage way 26 in which the liquid 28, shown as arrows, may flow from the inlet 24 around the passage way 26 and out through the channel 30. The channel 30 is shown as passing through the idler shaft 22 and bearings 32 are shown supporting the idler shaft 22. The fluid 28 is capable of flowing through the channel 30.

Figure 5:
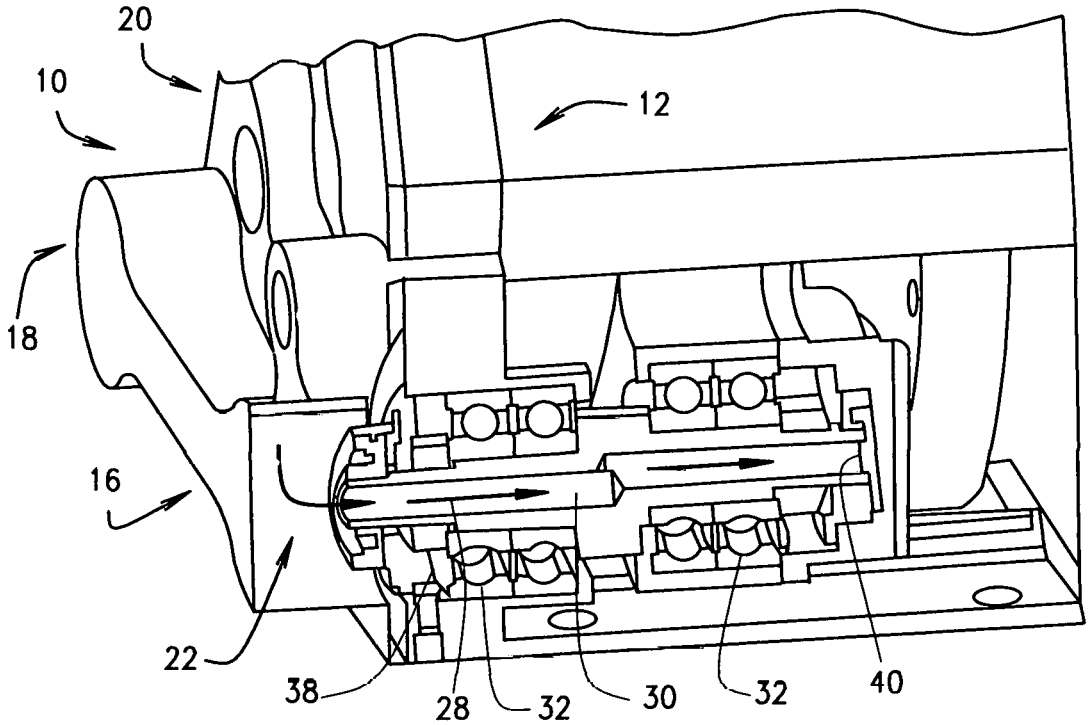
FIG. 5 is a partial side view of the scroll device, shown partially in phantom, showing the flow of cooling fluid through the idler shafts into the orbiting scroll.

Referring now to FIG. 5, a partial side view of the scroll device 10, shown partially in phantom, is illustrated. The scroll device 10 has the housing 12 and the fixed scroll 16 having the channel 30 that passes through the idler shaft 22 from the fixed scroll 16 to an orbiting scroll 36. Although the idler shaft 22 is shown, it is to be understood that the other idler shafts 18 and 20 also have the channel 30 in which the fluid 28 may flow or pass. As the fluid 28 flows from the fixed scroll 16 to the orbiting scroll 36, any heat generated by the scrolls 16 and 36 is transferred to the liquid 28. The idler shaft 22 also has radial shaft seals 38 that are used to prevent an leakage of the liquid 28 into the bearings 32. An access cross hole 40 is also provided for sealing checks.

Figure 6:
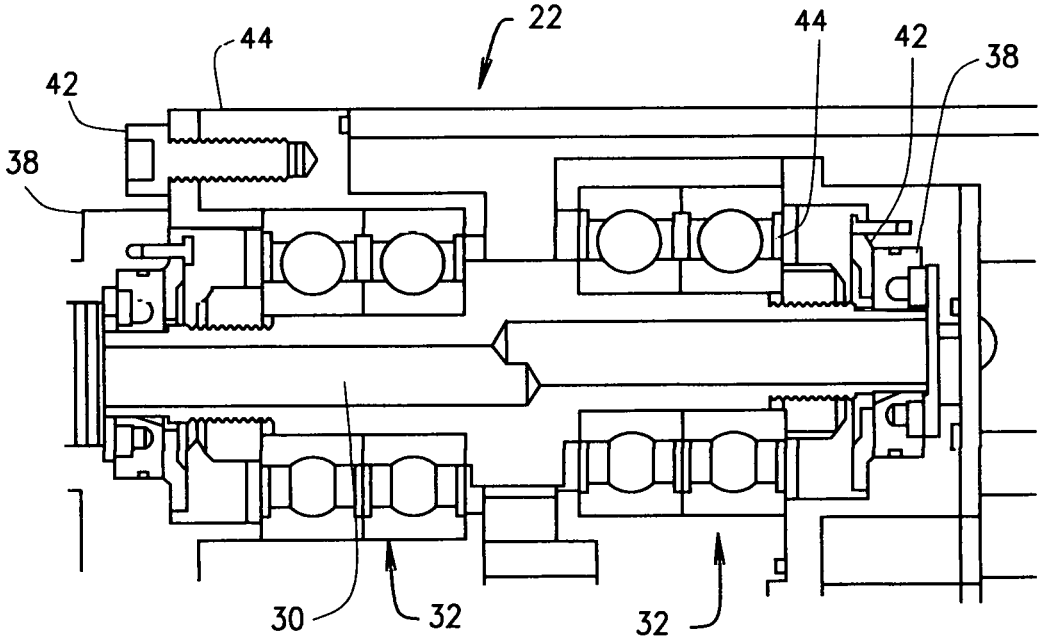
FIG. 6 is a partial cross-section of an idler shaft of the scroll device constructed according to the present disclosure.

FIG. 6 shows a partial cross-section of the idler shaft 22. The idler shaft 22 has the channel 30 that is used to receive the fluid 28 (not shown) there through. The idler shaft 22 also has the radial shaft seal 38, a seal retainer plate 42, a Nilos seal 44, and the sealed bearings 32.

Figure 7:
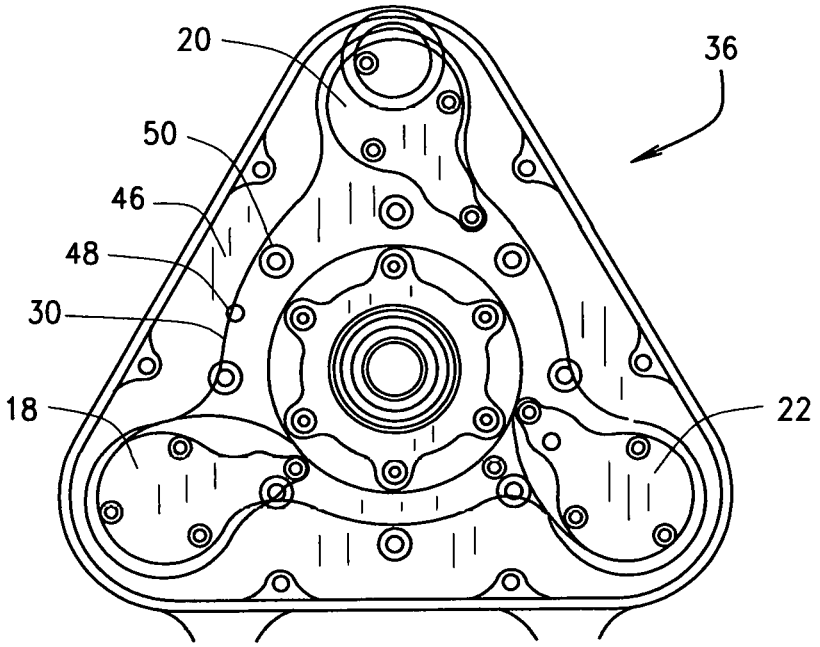
FIG. 7 is a side view of an orbiting scroll of the scroll device constructed according to the present disclosure.

With particular reference now to FIG. 7, a side view of the orbiting scroll 36 is shown. The orbiting scroll 36 is capable of having the cooling fluid or liquid 28 (not shown) pass into a jacket 46. The jacket 46 has caps 48 that are used to cover the channel 30. Sealing to prevent leakage of the liquid 28 is accomplished by the use of O-rings 50.

Figure 8:
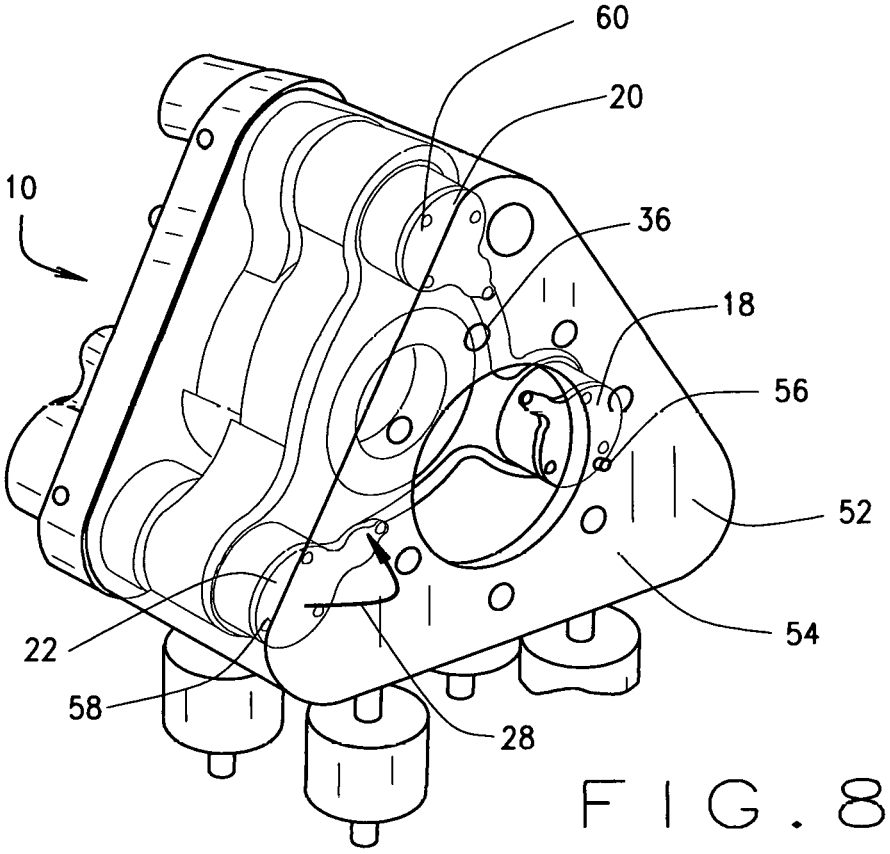
FIG. 8 is a perspective view of the scroll device shown partially in phantom.

FIG. 8 illustrates a perspective view of the scroll device 10 shown partially in phantom. The scroll device 10 has the orbiting scroll 36 being cooled by the liquid 28 flowing through the idler shafts 18, 20, and 22 into a jacket 52. The jacket 52 is formed or machined so that the liquid 28 moves across the jacket 52 and then down into a cooling passage 54. The idler shafts 18 and 22 also have inlets 56 and 58, respectively, for the liquid 28 and the idler shaft 20 also has an outlet 60 for the liquid 28.

Figure 9:
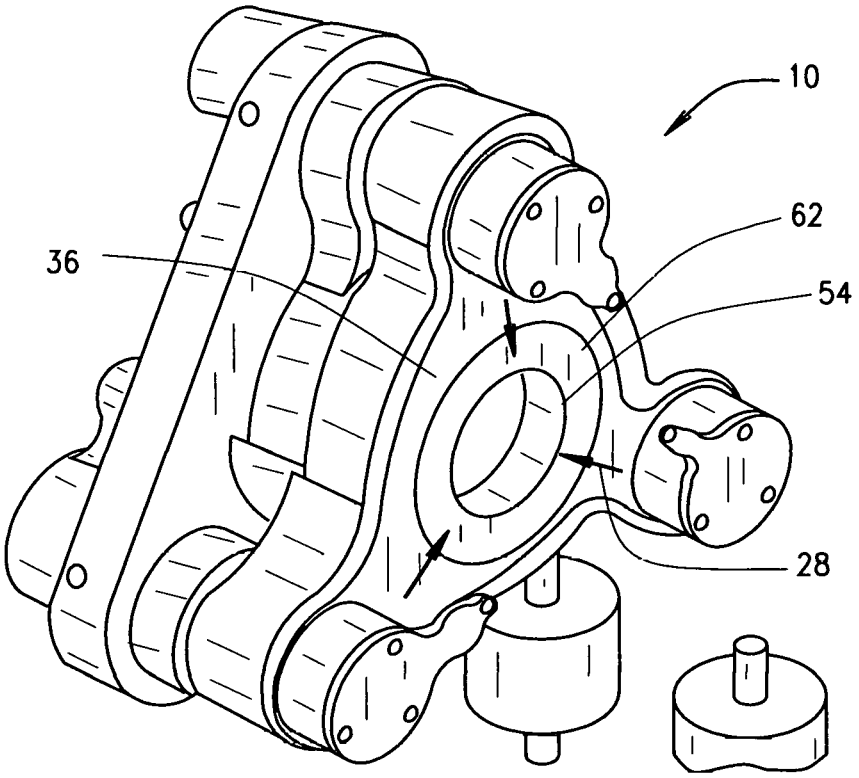
FIG. 9 is a perspective view of the scroll device shown partially in phantom.

Referring now to FIG. 9, a perspective view of the scroll device 10 is shown partially in phantom. The scroll device 10 has the liquid 28 that exits from cross channels 62 and passes through the jacket passage 54. Again, the liquid 28 is used to cool the orbiting scroll 36.

Figure 10:
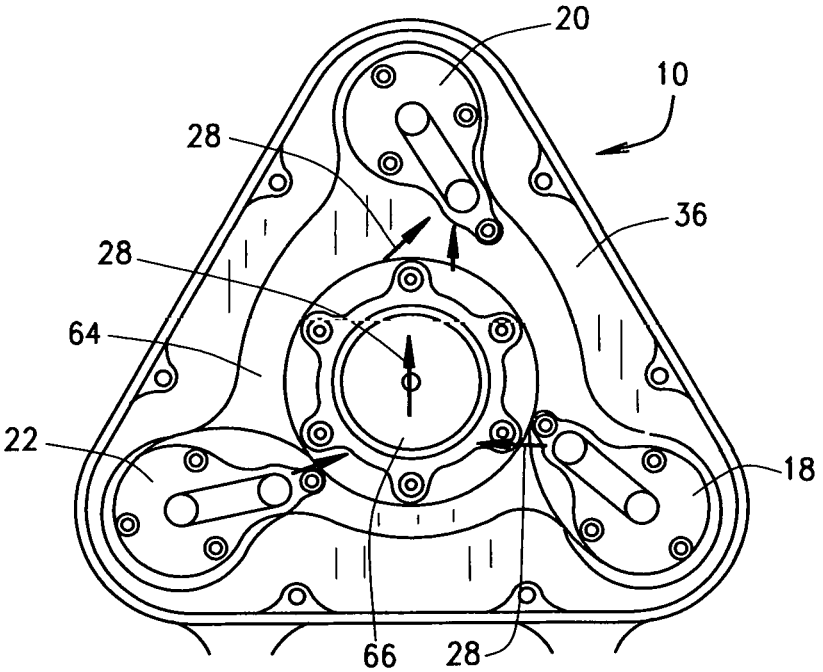
FIG. 10 is a side view of an orbiting scroll of the scroll device having a fin design.

FIG. 10 is a side view of the orbiting scroll 36 having a fin design. The orbiting scroll 36 uses fins 64 to direct or force liquid 28 to a center 66 of the scroll device 10. This minimizes any pressure drop and directs the flow of liquid 28 optimally to reduce any stagnated flow of liquid 28 in the scroll device 10. The idler shafts 18, 20, and 22 are also shown in this particular view.

Figure 11:
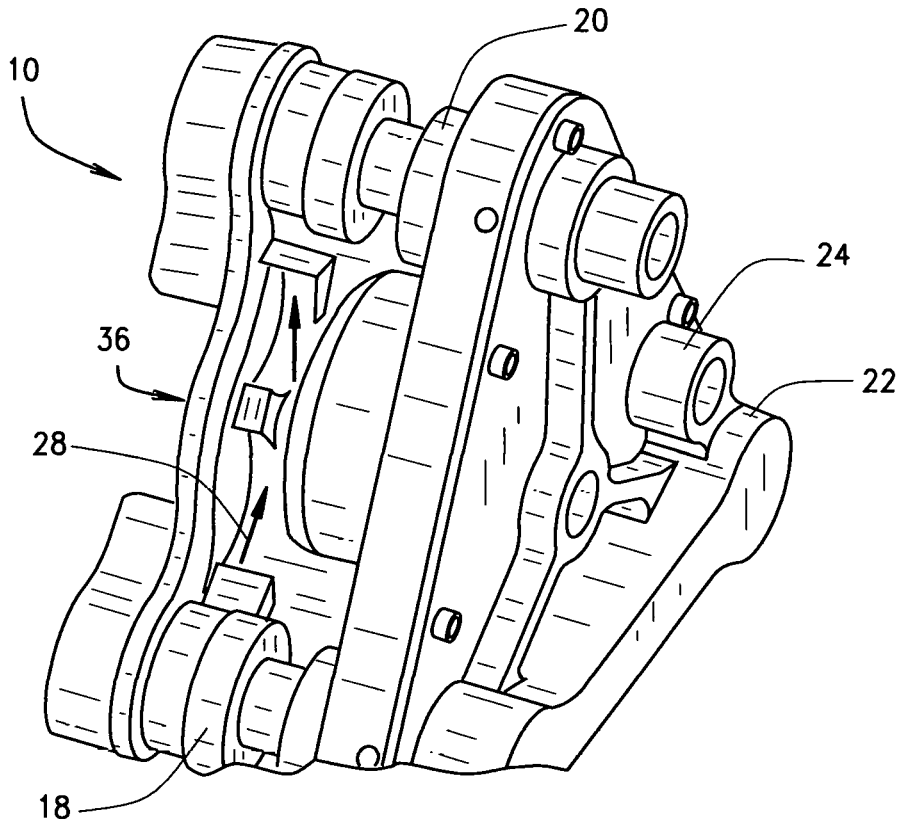
FIG. 11 is a partial perspective view of the scroll device, shown partially in phantom.

Turning now to FIG. 11, a partial perspective view of the scroll device 10, shown partially in phantom, is illustrated. The scroll device 10 has the orbiting scroll 36 with liquid 28 being able to exit through the idler shaft 20. Liquid 28 is also enter through the idler shafts 18 and 22. The inlet 24 is also depicted in this particular view.

Figure 12:
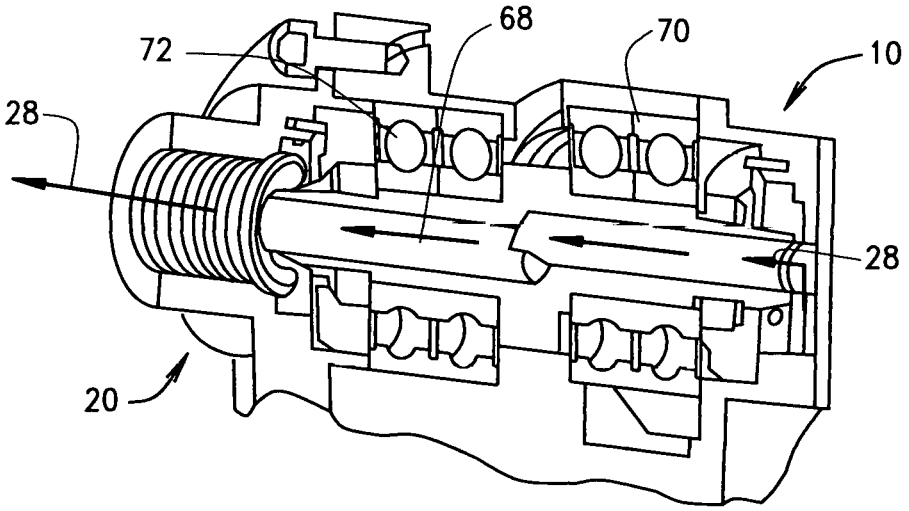
FIG. 12 is a partial perspective view of an idler shaft of the scroll device constructed according to the present disclosure, with components of the scroll device shown partially in phantom.

FIG. 12 is a partial perspective view of the idler shaft 20 of the scroll device 10 shown partially in phantom. The idler shaft 20 has a channel 68 through which liquid 28 may flow. The idler shaft 20 is supported by a first bearing 70 and a second bearing 72. As liquid 28 passes through the channel 68, any heat generated by the scroll device 10 is transferred to the liquid 28.

Figure 13:
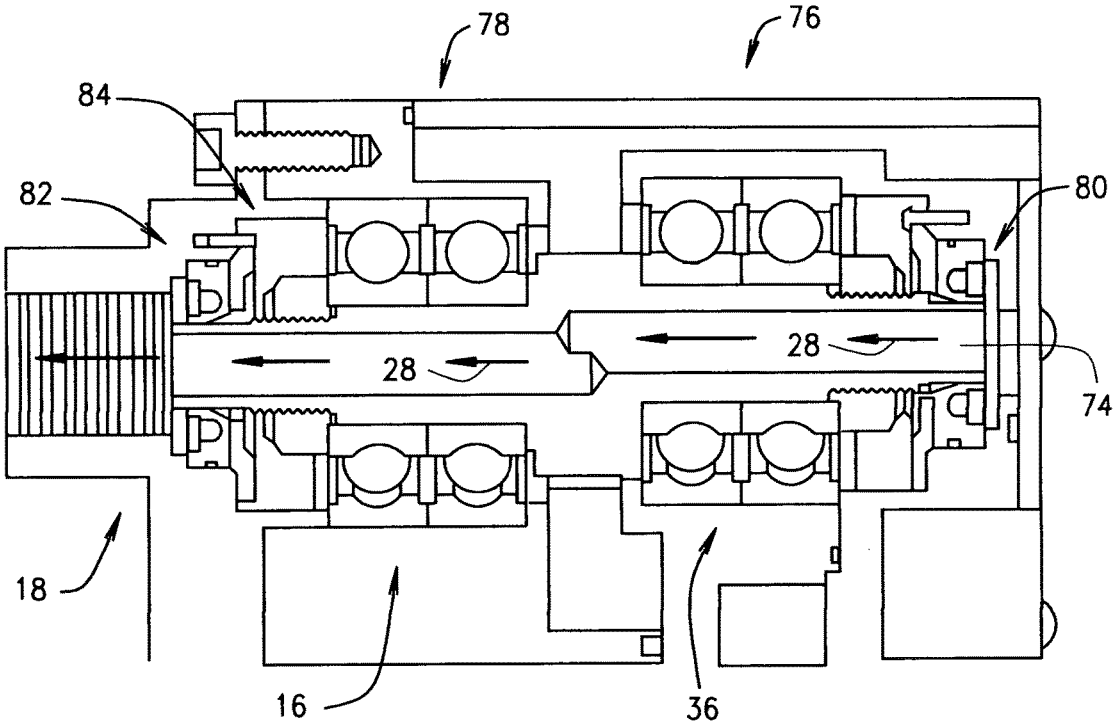
FIG. 13 is a partial cross-sectional view of an embodiment of the idler shaft constructed according to the present disclosure showing a lip type seal.

With particular reference now to FIG. 13, a partial cross-sectional view of the idler shaft 18 is shown. The idler shafts 20 and 22 constructed in the same manner. The idler shaft 18 has a channel 74 formed therein in which liquid 28 may pass or flow. The flow of liquid 28 is in an opposite direction to the flow of liquid 28 in the idler shaft 20 (See FIG. 12). The idler shaft 18 has a pair of first bearings 76 and a pair of second bearings 78. The fixed scroll 16 and the orbiting scroll 36 are also shown. The pair of first bearings 76 has a dynamic shaft seal 80 that is used to prevent any liquid 28 from contacting the pair of first bearings 76 or from escaping from the channel 74. The second pair of bearings 78 also has a dynamic shaft seal 82 that is used to seal the liquid 28 in the channel 74. A bearing slinger cover 84 positioned next to the pair of second bearings 78 is also used to prevent any liquid 28 from escaping from the channel 74.

Figure 14:
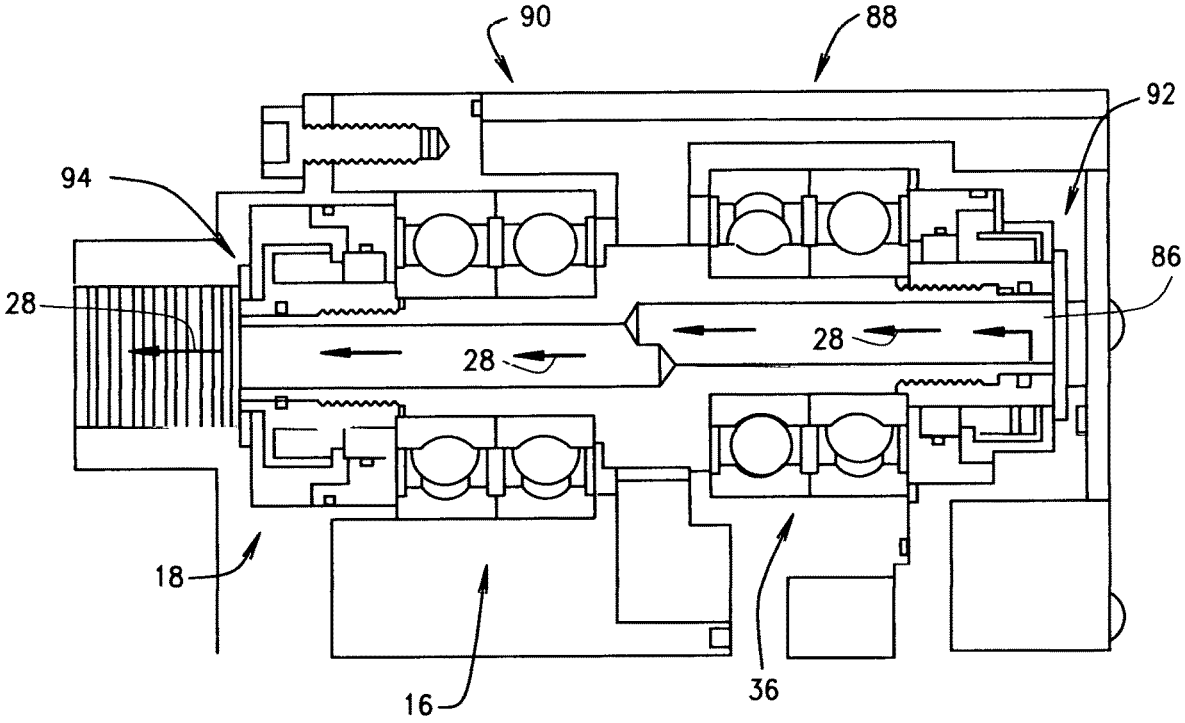
FIG. 14 is a partial cross-sectional view of another embodiment of the idler shaft constructed according to the present disclosure showing a mechanical shaft seal.

FIG. 14 shows a partial cross-sectional view of another embodiment of the idler shaft 18. The idler shafts 20 and 22 may be constructed in the same manner. The idler shaft 18 has a channel 86 formed therein in which liquid 28 may pass or flow. The flow of liquid 28 is in an opposite direction to the flow of liquid 28 in the idler shaft 20 (See FIG. 12). The idler shaft 18 has a pair of first bearings 88 and a pair of second bearings 90. The fixed scroll 16 and the orbiting scroll 36 are also shown. The pair of first bearings 88 has a mechanical shaft seal 92 that is used to prevent any liquid 28 from contacting the pair of first bearings 88 or from escaping from the channel 86. The second pair of bearings 90 also has a mechanical shaft seal 94 that is used to seal the liquid 28 in the channel 86.

Figure 15:
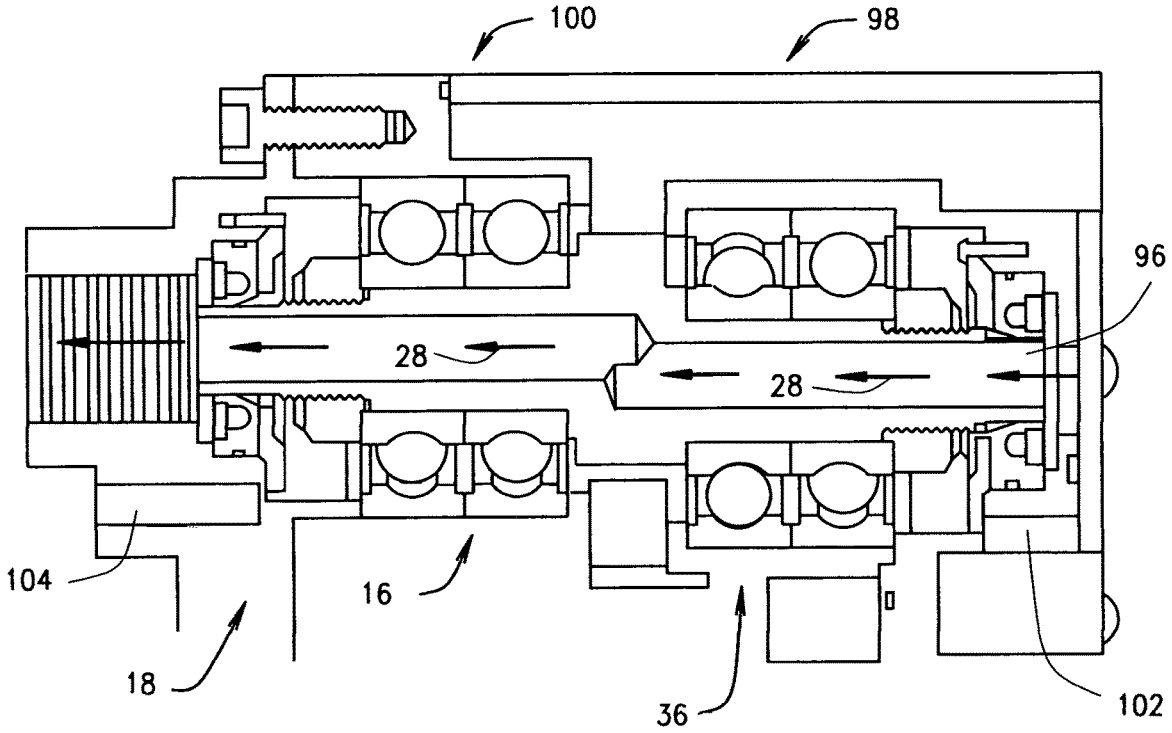
FIG. 15. is a partial cross-sectional view of another embodiment of the idler shaft constructed according to the present disclosure showing drain holes to drain off any cooling liquid that gets past the seals.

Referring now to FIG. 15, a partial cross-sectional view of another embodiment of the idler shaft 18 is depicted. The idler shafts 20 and 22 may be constructed in the same manner. The idler shaft 18 has a channel 96 formed therein in which liquid 28 may pass or flow. The flow of liquid 28 is in an opposite direction to the flow of liquid 28 in the idler shaft 20 (See FIG. 12). The idler shaft 18 has a pair of first bearings 98 and a pair of second bearings 100. The fixed scroll 16 and the orbiting scroll 36 are also shown. The pair of first bearings 98 has a drain 102 that is used to prevent any liquid 28 from contacting the pair of first bearings 98. The second pair of bearings 100 also has a drain 104 that is used to prevent any liquid 28 from contacting the pair of second bearings 100.

Figure 16:
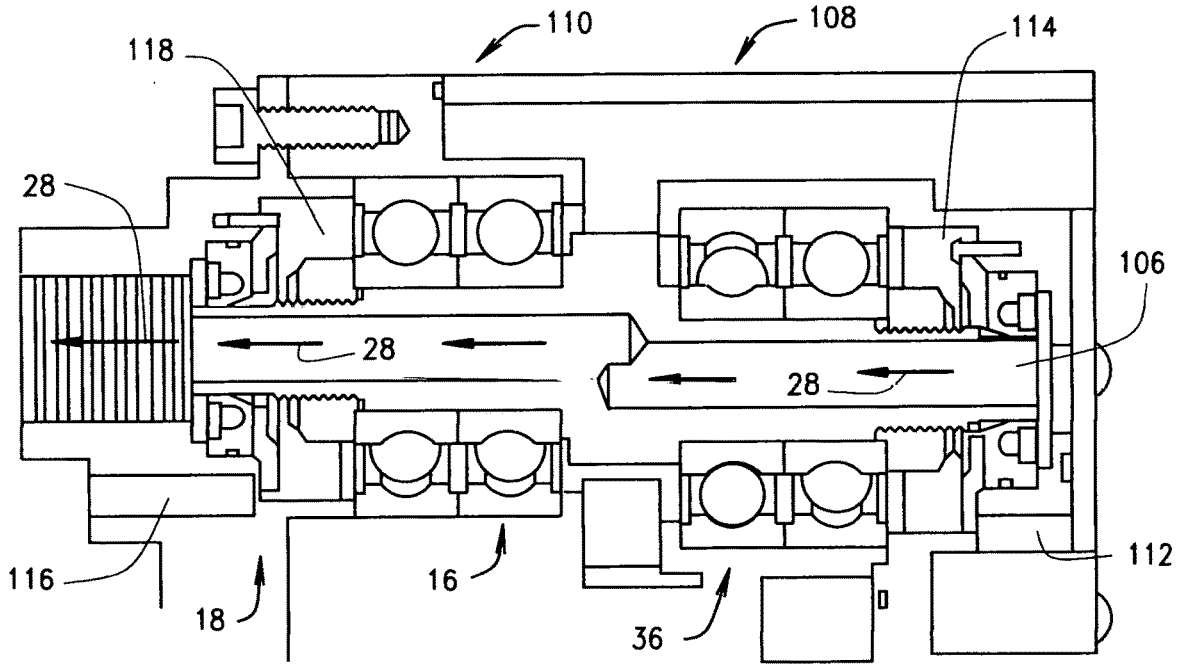
FIG. 16 is a partial cross-sectional view of another embodiment of the idler shaft constructed according to the present disclosure showing slingers to sling any cooling fluid that leaks past the seals away from the bearings.

FIG. 16 is a partial cross-sectional view of another embodiment of the idler shaft 18. The idler shafts 20 and 22 may be constructed in the same manner. The idler shaft 18 has a channel 106 formed therein in which liquid 28 may pass or flow. The flow of liquid 28 is in an opposite direction to the flow of liquid 28 in the idler shaft 20 (See FIG. 12). The idler shaft 18 has a pair of first bearings 108 and a pair of second bearings 110. The fixed scroll 16 and the orbiting scroll 36 are also shown. The pair of first bearings 108 has a drain 112 and a slinger 114 that are used to prevent any liquid 28 from contacting the pair of first bearings 108. The second pair of bearings 110 also has a drain 116 and a slinger 118 that are used to prevent any liquid 28 from contacting the pair of second bearings 110.

Figure 17:
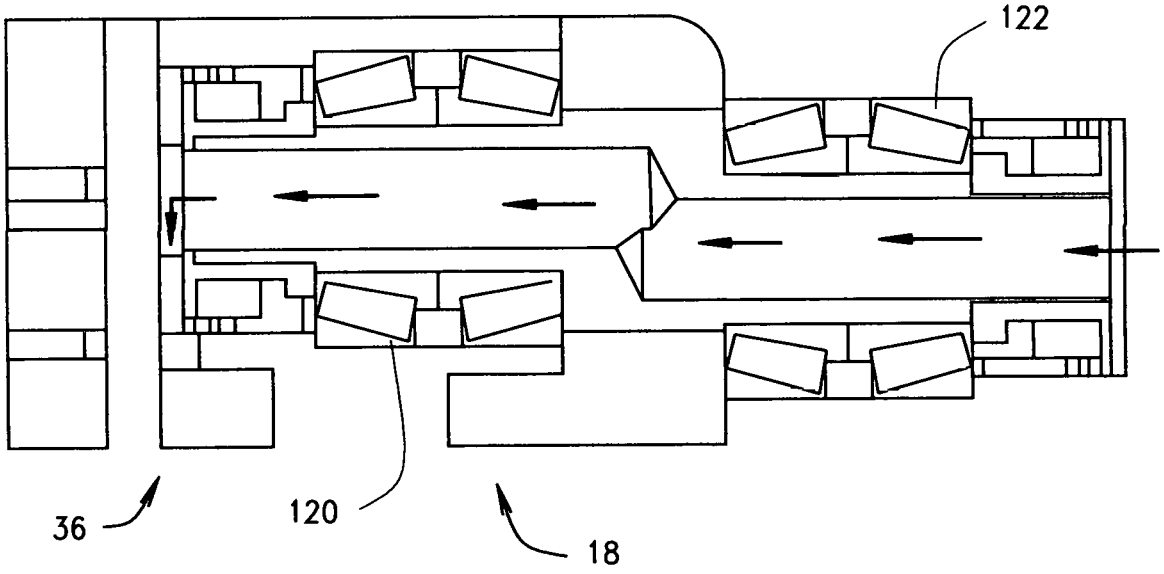
FIG. 17 is a partial cross-sectional view of another embodiment of the idler shaft constructed according to the present disclosure showing the idler shaft positioned behind the orbiting scroll.

With particular reference now to FIG. 17, a partial cross-sectional view of another embodiment of the idler shaft 18 is depicted. The idler shaft 18 is positioned behind the orbiting scroll 36 and is supported by bearings 120 in the orbiting scroll 36 and bearings 122 in the housing 12. All previously described variations of seals, drain holes, and stingers may be employed when the idler shaft 18 is positioned behind the orbiting scroll 36 as is shown in FIG. 17. Also, the other idler shafts 20 and 22 may be constructed in the same manner as the idler shaft 18 shown in FIG. 17.

From the aforementioned description, a scroll device 10 from the machine class of scroll compressors, pumps, and expanders has been described. The scroll device 10 is capable of expanding and compressing a fluid cyclically to evacuate a line, device, or space connected to the scroll device 10 without intrusion of the nearby atmosphere. The scroll device 10 receives its motive power directly from a motor or alternatively from a motor connected to a magnetic coupling, further minimizing the incidence of atmospheric intrusion within the housing and the working fluid. The present disclosure and its various components may adapt existing equipment and may be manufactured from many materials including but not limited to metal sheets and foils, elastomers, steel plates, polymers, high density polyethylene, polypropylene, polyvinyl chloride, nylon, ferrous and non-ferrous metals, various alloys, and composites.

From all that has been said, it will be clear that there has thus been shown and described herein a scroll device having liquid cooling through use of idler shafts. It will become apparent to those skilled in the art, however, that many changes, modifications, variations, and other uses and applications of the subject scroll device are possible and contemplated. All changes, modifications, variations, and other uses and applications which do not depart from the spirit and scope of the disclosure are deemed to be covered by the disclosure, which is limited only by the claims which follow.

What is claimed is:

1. A scroll device comprising:
- a housing;
- a motor having a shaft;
- an orbiting scroll connected to the shaft for moving the orbiting scroll;
- a fixed scroll mated to the orbiting scroll;
- an idler shaft for aligning the orbiting scroll and the fixed scroll, the idler shaft comprising a channel formed therein; and
- a cooling liquid inlet in fluid communication with the channel.

2. The scroll device of claim 1, further comprising a cooling liquid outlet in fluid communication with the channel.

3. The scroll device of claim 2, wherein the cooling liquid inlet is in fluid communication with the cooling liquid outlet via the channel.

4. The scroll device of claim 2, wherein each of the cooling liquid inlet and the cooling liquid outlet is positioned closer to the fixed scroll than the orbiting scroll.

5. The scroll device of claim 1, wherein the scroll device comprises a plurality of idler shafts for aligning the orbiting scroll and the fixed scroll, each of the idler shafts comprising the channel formed therein.

6. The scroll device of claim 5, further comprising a cooling liquid outlet, and wherein the cooling liquid inlet is in fluid communication with the cooling liquid outlet via both the channel of a first one of the plurality of idler shafts and the channel of a second one of the plurality of idler shafts.

7. The scroll device of claim 1, further comprising a fixed scroll jacket secured to the fixed scroll and an orbiting scroll jacket secured to the orbiting scroll.

8. The scroll device of claim 7, wherein the fixed scroll jacket comprises a cooling liquid outlet.

9. The scroll device of claim 7, further comprising a cooling liquid passageway between the fixed scroll jacket and the fixed scroll.

10. The scroll device of claim 7, further comprising a cooling liquid passageway between the orbiting scroll jacket and the orbiting scroll.

11. A scroll device comprising:
- a housing;
- a motor having a shaft;
- an orbiting scroll connected to the shaft for moving the orbiting scroll;
- a fixed scroll mated to the orbiting scroll via a plurality of idler shafts, at least one of the plurality of idler shafts comprising a channel formed therein; and
- a cooling liquid inlet in fluid communication with the channel.

12. The scroll device of claim 11, wherein each of the plurality of idler shafts is eccentric.

13. The scroll device of claim 11, further comprising a cooling liquid outlet.

14. The scroll device of claim 13, wherein the cooling liquid inlet is in fluid communication with the cooling liquid outlet via the channel.

15. The scroll device of claim 14, wherein cooling liquid enters the cooling liquid inlet which is closer to the fixed scroll than the orbiting scroll.

16. The scroll device of claim 15, wherein at least two of the plurality of idler shafts comprise a channel formed therein, and further wherein cooling liquid passes through the channel of a first one of the plurality of idler shafts in a first direction.

17. The scroll device of claim 16, wherein the cooling liquid outlet is positioned closer to the fixed scroll than the orbiting scroll, and cooling liquid passes through the channel of a second one of the plurality of idler shafts in a second direction that opposes the first direction.

18. A scroll device comprising:
- a housing;
- a motor having a shaft;
- an orbiting scroll connected to the shaft for moving the orbiting scroll;
- a fixed scroll mated to the orbiting scroll via at least one eccentric idler shaft, the at least one eccentric idler shaft comprising a channel formed therein, the channel extending from an outer surface of the fixed scroll to an outer surface of the orbiting scroll; and
- a cooling liquid inlet positioned closer to the fixed scroll than the orbiting scroll, the cooling liquid inlet in fluid communication with the channel, wherein cooling liquid enters the cooling liquid inlet and flows through the channel.

19. The scroll device of claim 18, wherein the at least one eccentric idler shaft comprises three eccentric idler shafts, each of the three eccentric idler shafts comprising a channel formed therein.

20. The scroll device of claim 19, further comprising a cooling liquid outlet positioned closer to the fixed scroll than the orbiting scroll, the cooling liquid outlet in fluid communication with the cooling liquid inlet via a path that extends through the channels of at least two of the three eccentric idler shafts.

* * * * *